US009836967B2

(12) United States Patent
Jeschke et al.

(10) Patent No.: US 9,836,967 B2
(45) Date of Patent: Dec. 5, 2017

(54) METHOD AND TRAFFIC MONITORING DEVICE FOR DETECTING A WRONG-WAY DRIVING INCIDENT OF A MOTOR VEHICLE

(71) Applicant: Robert Bosch GmbH, Stuttgart (DE)

(72) Inventors: Christian Jeschke, Beilstein (DE); Christian Braeuchle, Hassmersheim-Hochhausen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/916,750

(22) PCT Filed: Sep. 1, 2014

(86) PCT No.: PCT/EP2014/068473
§ 371 (c)(1),
(2) Date: Mar. 4, 2016

(87) PCT Pub. No.: WO2015/032709
PCT Pub. Date: Mar. 12, 2015

(65) Prior Publication Data

US 2016/0210855 A1 Jul. 21, 2016

(30) Foreign Application Priority Data

Sep. 6, 2013 (DE) ..... 10 2013 217 833
Nov. 15, 2013 (DE) ..... 10 2013 223 408
May 8, 2014 (DE) ..... 10 2014 208 673

(51) Int. Cl.
*G08G 1/01* (2006.01)
*G08G 1/056* (2006.01)
(Continued)

(52) U.S. Cl.
CPC ..... *G08G 1/056* (2013.01); *G08G 1/04* (2013.01); *G08G 1/042* (2013.01); *G08G 1/164* (2013.01); *G08G 1/166* (2013.01)

(58) Field of Classification Search
CPC ..... G08G 1/056; G08G 1/164; G08G 1/0133; G08G 1/127; G08G 1/00; G07B 15/00
(Continued)

(56) References Cited

U.S. PATENT DOCUMENTS 8,265,987 B2 * 9/2012 Goto ..... G07B 15/063 235/384
8,421,648 B2 * 4/2013 Konaka ..... B62D 15/029 340/438
(Continued)

FOREIGN PATENT DOCUMENTS

CN 101308576 A 11/2008
CN 103164988 A 6/2013
(Continued)

*Primary Examiner* — Toan N Pham
(74) *Attorney, Agent, or Firm* — Norton Rose Fulbright US LLP; Gerard Messina

(57) ABSTRACT

A method is described for detecting a wrong-way driving incident of a motor vehicle on a unidirectional roadway, using a traffic monitoring device. A motor vehicle is recognized by the traffic monitoring device, a moving direction of the motor vehicle is determined based on data of the traffic monitoring device, and a wrong-way driving incident is detected when a moving direction is against a direction of traffic of the unidirectional roadway. A traffic monitoring device for detecting a wrong-way driving incident of a motor vehicle on a unidirectional roadway is provided, which includes a recognizing arrangement to recognize a motor vehicle, a determining arrangement to determine a moving direction of the motor vehicle based on data of the traffic monitoring device, and a detecting arrangement to detect a wrong-way driving incident when a moving direction is against a direction of traffic of the unidirectional roadway.

19 Claims, 2 Drawing Sheets

(51) Int. Cl.
*G08G 1/04* (2006.01)
*G08G 1/042* (2006.01)
*G08G 1/16* (2006.01)

(58) Field of Classification Search
USPC ..... 340/935, 933, 928; 705/13; 235/384
See application file for complete search history.

(56) References Cited

U.S. PATENT DOCUMENTS

| | | | | |
|---|---|---|---|---|
| 8,428,861 | B1 * | 4/2013 | Williams | G08G 1/164 701/301 |
| 8,754,782 | B2 * | 6/2014 | Tagawa | G08G 1/075 340/438 |
| 8,947,259 | B2 * | 2/2015 | Tagawa | G08G 1/075 340/438 |
| 9,024,785 | B2 * | 5/2015 | Mochizuki | G08G 1/096775 340/425.5 |
| 9,251,707 | B2 * | 2/2016 | Kugel | G01C 21/3697 |
| 9,378,640 | B2 * | 6/2016 | Mimeault | G01S 17/023 |
| 9,478,138 | B2 * | 10/2016 | Nagy | G08G 1/166 |

FOREIGN PATENT DOCUMENTS

| | | |
|---|---|---|
| CN | 103208184 A | 7/2013 |
| DE | 10 2007 027651 | 12/2008 |
| DE | 10 2010 025379 | 12/2011 |
| DE | 10 2013 201821 | 8/2014 |
| EP | 1 339 033 | 8/2003 |
| EP | 2 306 428 | 4/2011 |

* cited by examiner

METHOD AND TRAFFIC MONITORING DEVICE FOR DETECTING A WRONG-WAY DRIVING INCIDENT OF A MOTOR VEHICLE

FIELD OF THE INVENTION

The present invention relates to a method and a traffic monitoring device for detecting a wrong-way driving incident of a motor vehicle on a unidirectional roadway, using a traffic monitoring device.

BACKGROUND INFORMATION

Wrong-way drivers, also referred to as "ghost drivers," cause deaths, injuries, and significant property damage in the event of an accident. A wrong-way driving incident is understood here to mean driving against the compulsory direction of traffic on a unidirectional roadway. A unidirectional roadway is a roadway that is structurally separated from oncoming traffic. Unidirectional roadways are found on expressways or thruways, such as upgraded federal highways. Wrong-way driving incidents may be divided into forward travel and reverse travel, forward travel being initiated by wrongly entering an off-ramp or by turning.

Over one-half of wrong-way driving incidents start at junctions of expressways. In particular, wrong-way driving incidents on expressways, cause accidents due to the high vehicle speeds, and thus the high collision speeds, frequently with fatal consequences.

Recognizing wrong-way driving incidents via navigation devices is not always reliably possible, since the information of the navigation device, such as road class and direction, is provided too late for most cases of wrong-way driving incidents; i.e., the vehicles are then already in the driving path against the direction of traffic.

SUMMARY OF THE INVENTION

The method according to the present invention for detecting a wrong-way driving incident of a motor vehicle on a unidirectional roadway, using a traffic monitoring device, basically includes the following steps:

- recognizing a motor vehicle based on data of the traffic monitoring device;
- determining a moving direction of the motor vehicle by the traffic monitoring device; and
- detecting a wrong-way driving incident when a moving direction is against a direction of traffic of the unidirectional roadway.

The present method considers the targeted detection of a wrong-way driving behavior of a motor vehicle on a unidirectional roadway such as an expressway. For this purpose, it is initially recognized whether a vehicle is present in the detection range of the traffic monitoring device. If this is the case, the moving direction is determined, i.e., whether the motor vehicle is situated in a compulsory direction on the unidirectional roadway or is situated in an incorrect or prohibited direction opposite thereto. A wrong-way driving incident is then detected. The infrastructure of the traffic monitoring, which is already present, is advantageously used for detecting wrong-way driving incidents, which is easy to implement.

In one particular specific embodiment, the moving direction is determined by image recognition of a front side or rear side of the motor vehicle facing the traffic monitoring device. The moving direction may thus be detected with only one image which shows a vehicle on the unidirectional roadway. The determination is based on a detection direction of the traffic monitoring device; it is assumed here that the front side or front end of a vehicle is detected by three-dimensional scanning or a camera via a single image or video film. If the image then shows the front side of a vehicle, the vehicle is moving in the direction of traffic of the unidirectional roadway. However, if the image shows the rear side or rear end of a vehicle, the vehicle is moving against the direction of traffic of the unidirectional roadway. If the detection is directed toward the rear side of the vehicle, the determination behaves conversely. Determining both detection directions at the same time is also possible. In this case, the determination may take place when one detection direction shows a result or when both detection directions show a consistent result.

According to one specific embodiment of the present invention, it is provided that the moving direction is alternatively or additionally determined by comparing at least two images of the motor vehicle recorded by the traffic monitoring device. The moving direction or driving direction of the vehicle is extracted from the change in position of the motor vehicle in the images. This does not require three-dimensional recognition, and may also identify or determine the moving direction of vehicles which are improperly travelling in reverse.

Furthermore, the moving direction may be determined with the aid of communication between a transmitter and/or receiver unit(s) of the motor vehicle and a transmitter and/or receiver unit(s) of the traffic monitoring device. This determination may be carried out as an alternative or in addition to the two types of determination mentioned above. Shared determination or plausibility checking in two or three ways increases the reliability and robustness of the method. It may then be provided to use one, multiple, or all moving directions for the determination and/or the detection.

The traffic monitoring device advantageously includes a toll device, a traffic camera, and/or induction strips provided in the unidirectional roadway. In this way, an infrastructure which is widely distributed over the road network and already proven and tested may be expanded by the additional task of wrong-way driver detection. The toll gantries installed on expressways and some federal highways in Germany operate with automatic license plate recognition for determining the license plate, as well as with sensors, for example laser sensors for three-dimensional detection, for detecting the type of vehicle. These capabilities may now advantageously be used for detecting wrong-way driving incidents.

After a wrong-way driving incident is detected, a warning may be output to the motor vehicle and/or other road users. Traffic safety may thus be increased, since the wrong-way driver and/or other road users endangered thereby is/are warned of the detected wrong-way driving incident.

It is also possible for the warning to include the activation of optical warnings and/or a wirelessly transmitted message to the motor vehicle and/or to other road users. The optical warnings may, for example, be output in the motor vehicles, or optical aids may be activated directly at the traffic monitoring device. In addition, it is possible to use variable traffic signs or dynamic traffic signs, for example of a route guidance system, for outputting a warning. The wireless message or warning may be transmitted either directly to a motor vehicle, for example in a vehicle ad hoc network (Car2X), or indirectly via a message to a radio-based traffic service such as a radio station.

It is advantageously provided that a lane of the unidirectional roadway is determined in which a motor vehicle is situated driving the wrong-way. The robustness and reliability of the method and the safety of vehicles and occupants may be further increased as a result of this precise resolution.

According to the present invention, a traffic monitoring device for detecting a wrong-way driving incident of a motor vehicle on a unidirectional roadway is provided, which includes an arrangement for recognizing a motor vehicle, an arrangement for determining a moving direction of the motor vehicle based on data of the traffic monitoring device, and an arrangement for detecting a wrong-way driving incident in a moving direction against a direction of traffic of the unidirectional roadway. The same advantages and modifications apply as described above.

In addition, the traffic monitoring device may be part of a toll system. Since most automated toll systems have a powerful sensor system, this increases the reliability of the method and the safety of the motor vehicles and their occupants.

Advantageous refinements of the present invention are stated in the further descriptions herein and described in the description.

Exemplary embodiments of the present invention are explained in greater detail with reference to the drawings and the following description.

DETAILED DESCRIPTION

Figure 1:
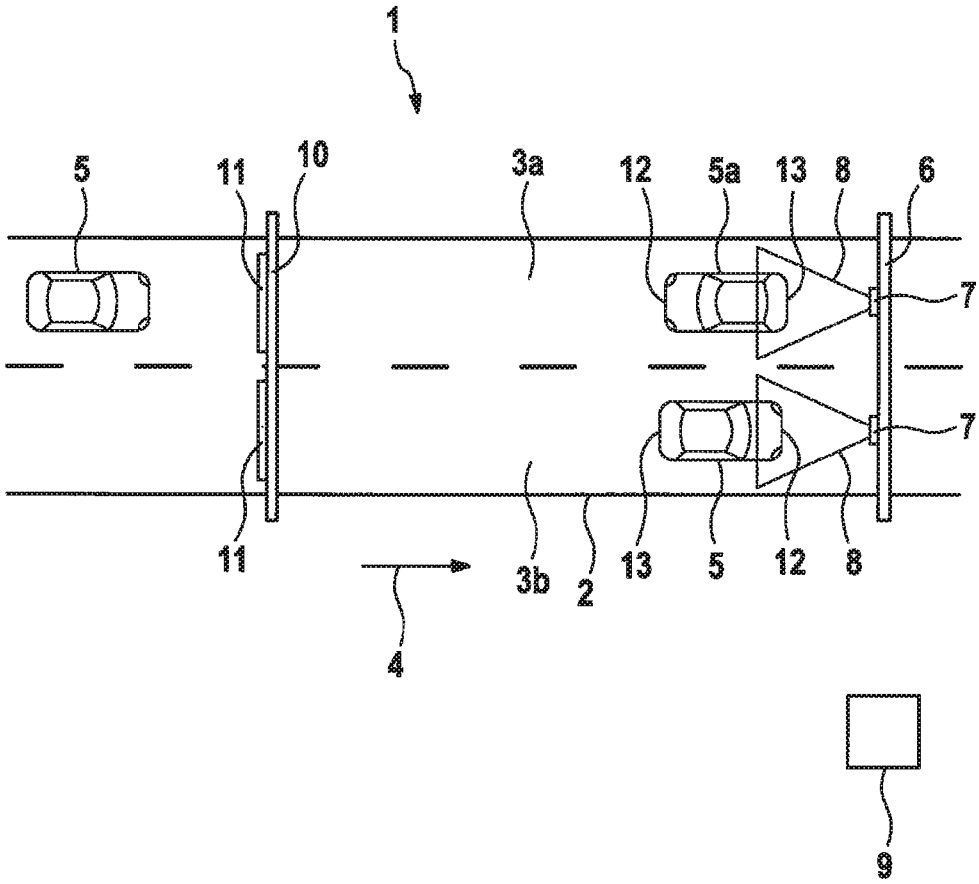
FIG. 1 shows a schematic illustration of a unidirectional roadway together with a traffic monitoring device.

FIG. 1 shows a road or expressway 1 with two structurally separated unidirectional roadways 2, of which one is illustrated.

Unidirectional roadway 2 includes two lanes 3, of which a left lane 3*a* is illustrated at the top and a right lane 3*b* is illustrated at the bottom. The designations "left" and "right" refer to a compulsory or correct direction of traffic 4 of unidirectional roadway 2. Multiple motor vehicles 5 are illustrated on lanes 3. The two motor vehicles 5 are moving in direction of traffic 4 of unidirectional roadway 2. A motor vehicle 5*a* is moving against direction of traffic 4, and therefore is driving the wrong way.

The term "vehicle" or "motor vehicle" is understood here to mean all driven arrangements of transportation, for example passenger vehicles, trucks, buses, motorcycles, etc.

A traffic monitoring device 6, for example a toll gantry, monitors lanes 3*a* and 3*b* of unidirectional roadway 2 with sensors 7. Sensors 7 each have a detection range 8. The dimensions or the size of detection range 8 may be limited to one lane, as illustrated here, or it is possible for detection ranges 8 of the two sensors to overlap. Image cameras, video cameras, laser scanners, and/or radar sensors, for example, may be used as sensors. Sensors 7 must be suitable, firstly, for detecting a motor vehicle 5 or its transit, and secondly, for determining a moving direction of the motor vehicle. In this regard, the mentioned capabilities do not have to be provided solely in sensors 7, and instead may be present, for example, in an external unit 9 such as a computer or a server, for example a traffic control center.

For the sake of clarity, FIG. 1 illustrates only two sensors 7, whose detection ranges 8 are directed oppositely to direction of traffic 4 of unidirectional roadway 2. Alternatively or additionally, further sensors whose detection ranges are situated in the direction of traffic may be provided.

Two variable traffic signs 11 are illustrated as part of a traffic guidance system 10. Variable traffic signs 11 may display various traffic signs or warnings, for example as a function of signals or commands of external unit 9. The distance between traffic monitoring device 6 and traffic or route guidance device 10 may be much greater than illustrated. It is also possible for multiple traffic guidance systems 10 or traffic monitoring devices 6 to be installed along unidirectional roadway 2.

During the detection of a motor vehicle 5 by sensor 7, the sensor initially detects an end side of motor vehicle 5. Depending on the driving direction of motor vehicle 5, this is a front side or front end 12, or a rear side or rear end 13. Thus, sensor 7 recognizes front side 12 of motor vehicle 5, traveling correctly on lane 3*b*. Sensor 7 recognizes rear side 13 of vehicle 5*a*, traveling incorrectly on lane 3*a*. Instead of recognizing only a front side 12 and/or a rear side 13 of motor vehicle 5, sensors 7 may generate an identification or signature of the motor vehicle during the transit of motor vehicle 5 through detection range 8, using the sensor data of front side 12, rear side 13, and an area of motor vehicle 5 situated in between.

Figure 2:
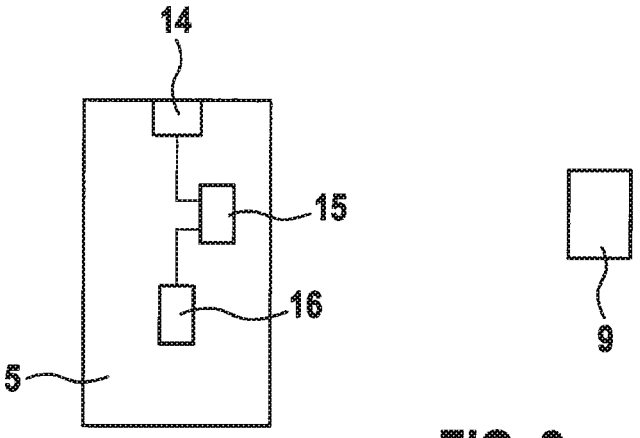
FIG. 2 shows a schematic illustration of a motor vehicle.

FIG. 2 schematically illustrates a motor vehicle 5 which, for example, corresponds to wrong-way driver 5*a* from FIG. 1. Motor vehicle 5 has a transmitter and/or receiver unit(s) 14 which is part of traffic monitoring device 6 or which may communicate with it. The communication may be uni- or bidirectional, and may be based on an infrared interface. In addition to the functions which are customary for the traffic monitoring or for the toll system, further functions or functionalities for detecting a wrong-way driving incident may be provided. Thus, for example, signals or signal sequences may be provided for the approach of motor vehicle 5 toward or its movement away from traffic monitoring device 6. In addition, specific warnings or active interventions into the steering or some other control of motor vehicle 5 may be output by traffic monitoring device 6.

Motor vehicle 5 also includes a controller 15. Controller 15 is in communication with transmitter and/or receiver unit(s) 14; this communication may be wired or wireless. Controller 15 is likewise connected to a communication interface 16 which is configured for communicating with external unit 9, such as a central server.

Transmitter and/or receiver unit(s) 14, controller 15, and communication interface 16 may be configured as independent units, as illustrated here, or may be integrated into one or multiple units. In particular, it is not necessary for each component to be configured as hardware; likewise, individual functions may be implemented as software routines or programs.

Pieces of information such as route information, and/or functionalities such as access to programs of external unit 9, may be provided to motor vehicle 5 with the aid of communication interface 16.

Motor vehicle 5 and traffic monitoring device 6 may be an integral part of a system such as a toll system. Similarly, external unit 9 may be part of the system and also part of a toll system. For this purpose, it may be necessary for motor vehicle(s) 5 to be specially equipped, for example with a communication interface or a communication protocol. In addition, optical markers which simplify the recognition of the vehicle and/or the determination of the moving direction of the vehicle may be provided on the vehicle.

Figure 3:
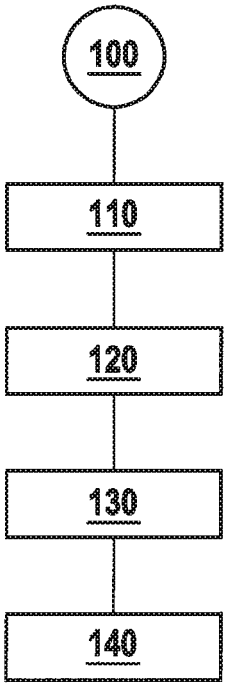
FIG. 3 shows, in the form of a flow chart, a method for a plausibility check of a wrong-way driving incident of a motor vehicle.

A method for detecting a wrong-way driving incident of a motor vehicle 5 is now described with reference to FIG. 3 in conjunction with FIGS. 1 and 2.

Traffic monitoring device 6 recognizes in a first step 100 whether a vehicle 5 is situated in detection range 8 of a sensor 7. The travel of a motor vehicle 5 into detection range 8 is established in this way.

The moving direction of motor vehicle 5 is then determined in a second step 110. This likewise takes place based on sensor system 7 of traffic monitoring device 6. The moving direction may be determined either directly in traffic monitoring device 6, or in external unit 9, for example a traffic control center. In principle, two moving directions of motor vehicle 5 are provided.

A moving direction which corresponds to a direction of traffic 4 of unidirectional roadway 2 shows a normal or correct travel of motor vehicle 5. A second moving direction opposite to direction of traffic 4 corresponds to a wrong-way driving incident of motor vehicle 5*a*. A moving direction is associated with a recognized or detected motor vehicle 5 with the aid of the data of one or multiple sensors 7 or with the aid of data derived from these sensor data.

Further pieces of information, for example the lane on which the motor vehicle is situated, or its speed, type, color, or the like, may be associated with the motor vehicle or likewise with a dataset of motor vehicle 5. This information may be used, for example, for providing a warning, to be subsequently generated, containing information concerning the wrong-way driver.

The determination of the moving direction may be based on multiple complementary sensors 7 or methods. Thus, for example, front side 12 or rear side 13 of the motor vehicle may be determined based on image recognition. In addition, the time sequence of multiple images may be compared. In this case, the movement of motor vehicle 5 may then be detected by the change in position of the motor vehicle in the various images. It is also possible for a communication with traffic monitoring device 6 to take place with the aid of transmitter and/or receiver unit(s) 14 of the motor vehicle, as the result of which the moving direction of motor vehicle 5 may be determined. The above steps and additional steps, for example the processing and/or the comparison of various sensor types and/or of identical sensors with different orientations, may be understood as criteria for plausibility checking. The moving direction may be determined if one, all, or a certain number of criteria for plausibility checking are met.

After the moving direction is determined and associated with motor vehicle 5, it is detected in a further step 120 whether a wrong-way driving incident of the motor vehicle is present. For this purpose, the moving direction of the motor vehicle is compared to direction of traffic 4 of unidirectional roadway 2. If the two directions are the same, there is no wrong-way driving incident. If the two directions are different or run in opposite directions, a wrong-way driving incident is detected. All, some, or only one certain moving direction(s) may be used in the detection of a wrong-way driving incident. When multiple sensors or multiple evaluation methods are used for determining a moving direction, a plausibility check for detecting a wrong-way driving incident may be implemented.

After a wrong-way driving incident is detected, a warning may be output to motor vehicle 5*a* which is driving the wrong way and/or to other road users 5 in a further step 130. For this purpose, for example variable traffic sign 11 may be activated by external unit 9. In addition, the drivers and/or occupants of vehicles 5*a* and 5 may be directly or indirectly informed.

Active responses to the detection may subsequently take place in a further step 140. This may include, for example, an intervention into the movement and/or steering of motor vehicle 5.

What is claimed is:

1. A method for detecting a wrong-way driving incident of a motor vehicle on a unidirectional roadway, using a traffic monitoring device, the method comprising:

setting a detection direction of the traffic monitoring device to at least one of: face toward oncoming traffic, or face toward receding traffic;

recognizing the motor vehicle by the traffic monitoring device;

determining a moving direction of the motor vehicle based on recognition in an image by the traffic monitoring device at least one of: a front side of the motor vehicle, or a rear side of the motor vehicle; and detecting the wrong-way driving incident when the moving direction is against a direction of traffic of the unidirectional roadway.

2. The method of claim 1, wherein the moving direction is determined at least based on image recognition of the front side of the motor vehicle facing the traffic monitoring device.

3. The method of claim 2, wherein the traffic monitoring device faces in a direction opposite the direction of traffic of the unidirectional roadway, and the wrong-way driving incident is detected when the front side of the motor vehicle is recognized.

4. The method of claim 2, wherein the traffic monitoring device faces in a same direction as the direction of traffic of the unidirectional roadway, and the wrong-way driving incident is detected when the rear side of the motor vehicle is recognized.

5. The method of claim 1, wherein the moving direction is determined by comparing at least two images of the motor vehicle recorded by the traffic monitoring device.

6. The method of claim 1, wherein the moving direction is determined with an aid of communication between a transmitter unit and/or receiver unit of the motor vehicle and a transmitter unit and/or receiver unit of the traffic monitoring device.

7. The method of claim 1, wherein the traffic monitoring device includes a toll device, a traffic camera, and/or induction strips provided in the unidirectional roadway.

8. The method of claim 1, wherein a warning is output to other road users after a wrong-way driving incident is detected.

9. The method of claim 8, wherein the warning includes the activation of optical warnings and/or a wirelessly transmitted message to the motor vehicle and/or to other road users.

10. The method of claim 1, wherein a lane of the unidirectional roadway is determined in which a motor vehicle is situated driving the wrong-way.

11. The method of claim 1, wherein the moving direction is determined at least based on image recognition of the rear side of the motor vehicle facing the traffic monitoring device.

12. The method of claim 1, wherein the moving direction is determined by recognition of the front side or rear side of the motor vehicle in a single image.

13. The method of claim 1, wherein the moving direction is determined based on a at least one factor in addition to the recognition of the front side or rear side of the motor vehicle.

14. The method of claim 13, wherein the at least one factor includes at least one of: a determination based on comparing at least two images of the motor vehicle recorded by the traffic monitoring device, or a determination based on communication between a transmitter unit and/or receiver unit of the motor vehicle and a transmitter unit and/or receiver unit of the traffic monitoring device.

15. The method of claim 13, wherein the at least one factor provides a plausibility check of the determination based on the recognition of the front side or rear side of the motor vehicle.

16. The method of claim 1, further comprising, in response to detecting the wrong-way driving incident, outputting a warning to a driver of the motor vehicle.

17. The method of claim 1, further comprising, in response to detecting the wrong-way driving incident, generating an intervention in at least one of: a movement of the motor vehicle, or a steering of the motor vehicle.

18. A traffic monitoring device for detecting a wrong-way driving incident of a motor vehicle on a unidirectional roadway, the traffic monitoring device comprising:

a detection direction arrangement to set a detection direction of the traffic monitoring device to at least one of: face toward oncoming traffic, or face toward receding traffic;

a recognizing arrangement to recognize the motor vehicle;

a determining arrangement to determine a moving direction of the motor vehicle based on recognition in an image by the traffic monitoring device at least one of: a front side of the motor vehicle, or a rear side of the motor vehicle; and a detecting arrangement to detect the wrong-way driving incident when the moving direction is against a direction of traffic of the unidirectional roadway.

19. The traffic monitoring device of claim 18, wherein the traffic monitoring device is part of a toll system.

* * * * *